United States Patent [19]

Shah

[11] Patent Number: 4,982,747

[45] Date of Patent: Jan. 8, 1991

[54] NAIL CLIPPER WITH NAIL POSITIONING DEVICE

[75] Inventor: Nyan S. Shah, Mentor, Ohio

[73] Assignee: JNN International, Mentor, Ohio

[21] Appl. No.: 269,450

[22] Filed: Nov. 10, 1988

[51] Int. Cl.[5] ..... A45D 29/18

[52] U.S. Cl. ..... 132/75.5; 132/75.4; 30/28

[58] Field of Search ..... 132/73, 73.5, 75.3, 132/75.4, 75.5; 30/26, 27, 28, 29

[56] References Cited

U.S. PATENT DOCUMENTS

| | | | |
|---|---|---|---|
| 838,755 | 12/1906 | Smith | 30/29 |
| 2,960,766 | 11/1960 | Whittle | D28/60 |
| 3,812,868 | 5/1974 | Keating | 132/75.4 |
| 4,637,137 | 1/1987 | Husain | 30/27 |

FOREIGN PATENT DOCUMENTS

| | | | |
|---|---|---|---|
| 2413887 | 10/1975 | Fed. Rep. of Germany | 30/28 |
| 8638 | 7/1886 | United Kingdom | 30/28 |

*Primary Examiner*—Gene Mancene
*Assistant Examiner*—Michael Lynch
*Attorney, Agent, or Firm*—Hill, Van Santen, Steadman & Simpson

[57] ABSTRACT

A nail clipper of the kind having spring arms arranged to be driven into nail clipping engagement of clipper jaws, is equipped with a nail positioning device mounted on or about the pin to which the lever is connected, and the device is held in nail positioning orientation relative to the clipper jaws when the lever is in the force applying operative relation. An antitilt member may also be provided. The device may comprise dual nail length gauging and antitilt structures which may be separate members, or combined in one member. The nail length gauging member may be adjustable for attaining selected nail length trimming positions.

15 Claims, 1 Drawing Sheet

NAIL CLIPPER WITH NAIL POSITIONING DEVICE

BACKGROUND OF THE INVENTION

This invention relates to improvements in nail clippers and is more particularly concerned with new and improved nail positioning devices for such clippers.

Conventional nail clippers of the kind having spring arm carried clipping jaws are widely used and, in general, function efficiently for the intended purpose. While for some users precise clipped nail length may not be important, there are other users, and especially female users, who are particular about the length of their clipped nails. This applies particularly to finger nails, but may also apply to toe nails where open toe footwear is popular.

Attainment of approximate clipped nail length accuracy is possible if extreme care is taken by the user of a clipper without any special length gauge, but that may be a time consuming, and for some persons quite arduous task. It may even be an impossible maneuver for persons of poor eyesight or other frustrating disability.

Although there have been attempts at providing means for determining clipped nail length accuracy, such as in U.S. Pat. No. 838,755 showing a generally scissors action nail trimmer with a finger receiving recess in the front end of one of the blade members, and U.S. Pat. No. 3,812,868 showing a conventional clipper with a fingertip guard member extending through a specially structured clipper jaw, there is considerable room for improvement.

SUMMARY OF THE PRESENT INVENTION

An important object of the present invention is to provide new and improved simple and efficient nail gauging or positioning structure for nail clippers.

Another object of the present invention is to provide new and improved nail positioning structure for conventional nail clippers and which can be selectively applied to such clippers without substantial alteration of the conventional structure of the clippers.

A further object of the invention is to provide new and improved nail positioning devices that can be inexpensively produced and applied to conventional nail clippers.

To the attainment of these and other objects of the invention there is provided in combination in a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including a nail positioning device mounted on or about the pin, and means for holding said device in nail positioning orientation relative to the clipper jaws when the lever is in the force applying operative relation.

BRIEF DESCRIPTION OF THE DRAWINGS

Other objects, features and advantages of the present invention will be readily apparent from the following detailed description of representative embodiments thereof, taken in conjunction with the accompanying drawing, although variations and modifications may be effected without departing from the spirit and scope of the novel concepts embodied in the disclosure, and in which.

DETAILED DESCRIPTION OF THE PRESENT INVENTION

Figure 1:
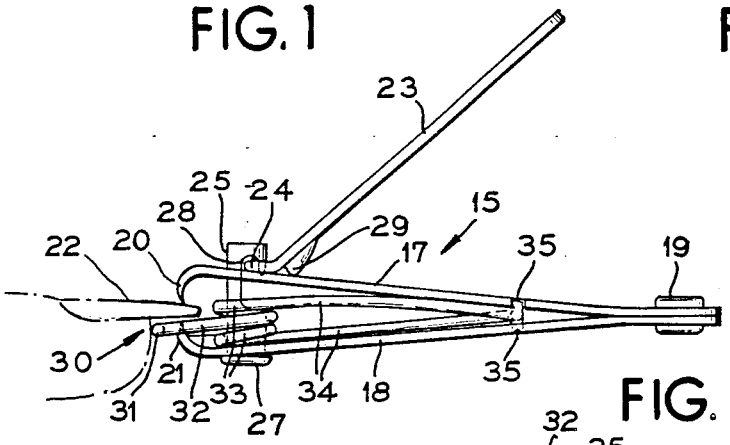
FIG. 1 is a side elevational view of a nail clipper equipped with a nail positioning device embodying the present invention.
Figure 2:
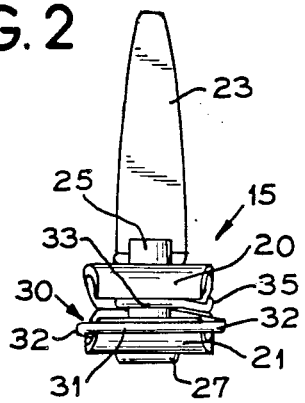
FIG. 2 is a front elevational view of the clipper of FIG. 1.
Figure 3:
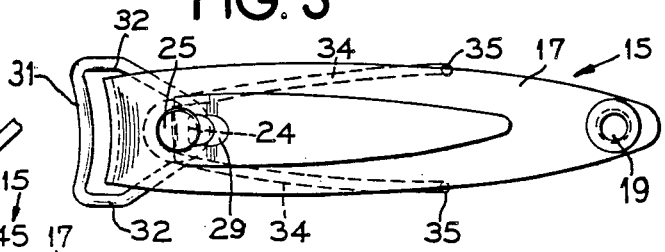
FIG. 3 is a top plan view of the clipper of FIGS. 1 and 2.

As shown in FIGS. 1, 2 and 3, a best mode embodiment of the present invention is depicted in combination with a conventional nail clipper 15 which has generally mirror image spring arms comprising an upper arm 17 and a lower arm 18 diverging from a fixed rear end connection such as a rivet 19. At the opposite front or working end of the clipper the arm 17 has a cutting edge jaw 20 and the arm 18 has a complementary cutting edge jaw 21, with the cutting edges facing toward one another and normally spaced apart so as to receive therebetween a finger nail 22 to be trimmed. As is customary, the jaws 20 and 21 are of a concave form, as viewed in plan in FIG. 3. The cutting edges are arranged to be driven into nail clipping engagement by an operating handle lever 23 pivotally connected by means of a terminal force transmission cross bar 24 to a connecting pin 25 which extends oscillatably through aligned holes in the arms 17 and 18 adjacent to the jaws 20 and 21. At its lower end, the pin 25 has a retaining flange 27, while the opposite, upper or head end of the pin projects above the upper arm 17 and has a hooked recess 28 in which the transmission bar 24 is engaged. This retains the lever and pin assembled with the clipper arms. The handle lever 23 is adapted to be swung by rotation of the pin 25 about the pin axis between a nail clipping force applying operative relation wherein a fulcrum 29 on the lever engages the arm 17 as shown in FIG. 1, and an out-of-the-way inactive relation to the arms 17 and 18 as shown in dash outline in FIG. 10. By rocking the lever 23 about its fulcrum 29, the spring arms are moved against their spring bias into nail clipping engagement of the jaws 20 and 21.

According to the present invention, a nail positioning device 30 (FIGS. 1, 2 and 3) is mounted about the pin 25 and is adapted to gauge the length of the nail 22 after it has been clipped by the jaws 20 and 21 Stated another way, the device 30 determines or gauges the amount of the nail 20 to be removed by the clipper. In a simple, inexpensive, and efficient construction, the device 30 comprises a wireform structure providing a gauging shoulder 31 in the form of a transverse bar shaped to receive the finger nail 22 thereon with the contiguous finger tip thrust against the shoulder 31. The shoulder 31 is desirably curved generally parallel to the curvature of the clipper jaws 20 and 21 and is sufficiently longer than the width of the jaws so that integral rearwardly extending supporting arms 32 at the opposite ends of the shoulder can clear the jaws 20 and 21 and converge generally toward the pin 25. Each of the arms 32 has a loop 33 which engages about the pin 25, and each of the loops has means for holding the device 30 in nail positioning orientation relative to the clipper jaws 20 and 21 when the lever 23 is in the force applying operative relation to the clipper arm 17, and in this instance comprising for each of the loops 33 an elongated extension 34. By forming the device 30 from resilient wire, the extensions 34 are tensioned to effect holding grip of a terminal finger lug 35 on one of the extensions 34 with an edge at one side of the clipper arm 17 and a holding grip of a similar terminal finger lug 35 on the terminal end of the other of the extensions 34 with the edge at the opposite side of the arm 18. As best seen in FIGS. 1 and 2, the shoulder bar 31 is desirably supported in a position a predetermined distance spaced in front of the jaws 20 and 21 and with its upper surface is about level with the cutting edge of the lower clipper jaw 21, so that the finger nail will be properly positioned relative to the clipper cutting edges for gauged length clipping.

Figure 4:
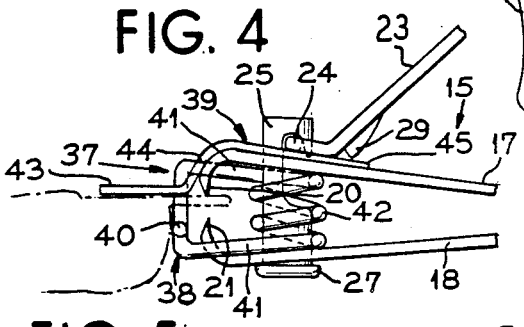
FIG. 4 is a fragmental view similar to FIG. 1 but showing a modification on larger scale.
Figure 5:
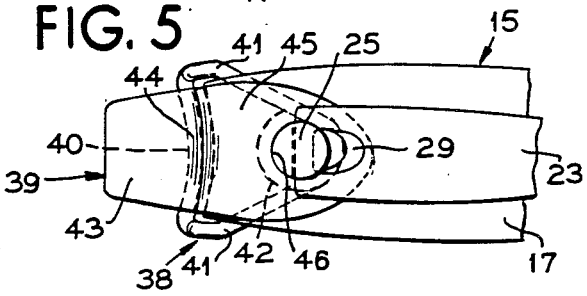
FIG. 5 is a top plan view of FIG. 4.

In another arrangement, as shown in FIGS. 4 and 5, the structure of the clipper 15 is the same as in FIG. 1, but a two part dual nail positioning device 37 is depicted which comprises a wireform shoulder member 38 and an overlying antitilt positioning plate member 39. The shoulder member 38, in this instance, comprises a one-piece unitary wireform construction having a shoulder bar 40 which is of a length to extend from side to side and preferably generally parallel to the jaws 20 and 21 while supporting arms 41 converge generally toward the pin 25 and are connected by a spiral loop construction 42 engaging freely about the pin 25 and of a length to maintain the shoulder 40 in proper vertical orientation relative to the jaw 21. The arms 41 are designed to cooperate with the opposite side edges of the respective jaws 20 and 21 to serve as means, together with the spiral loop 42, for holding the wireform device in nail positioning orientation relative to the clipper jaws.

The nail positioning plate 39 is carried by and functions to avoid tilting of the nail to be trimmed or clipped relative to the clipper jaws 20 and 21 during a nail trimming operation. To this end, the plate member 39 comprises a simple plate structure which has a forwardly extending antitilt overhang finger guide portion 43 desirably located substantially in a plane with the cutting edge of the upper jaw 20. Extending rearwardly from the antitilt portion 43 is retaining means comprising an integral interlock offset 44 which is generally conformed to the conventional concave shoulder formation of the upper jaw 20 whereby to hold the plate 39 against swiveling out of position. Extending rearwardly from the offset 44 is an integral plate body anchor portion 45 resting on and firmly held against the top of the arm 17 rearwardly from the jaw 20 by engagement of the fulcrum end portion of the lever 23 firmly against the anchor portion 45 by virtue of the relative spreading spring tension of the arms 17 and 18 confined by the interconnected lever 23 and pin 25. Holding of the plate 39 against displacement forwardly from its operating position is the pin 25 which extends through a complementary hole 46 in the plate anchor portion 45. Through this arrangement, in a nail trimming operation, not only is the nail properly positioned as to length by fingertip abutment against the shoulder 40 but the nail is also positioned against tilting relative to the clipper jaws by the overlying antitilt portion 43.

Figure 6:
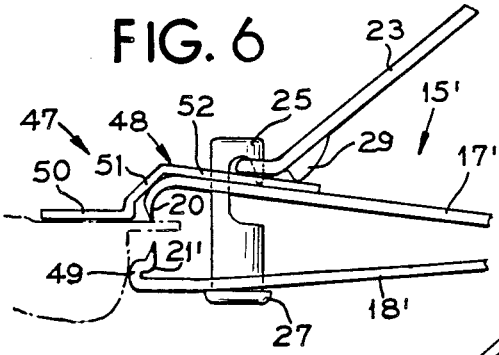
FIG. 6 is a side elevational view similar to FIG. 4 but showing another modification.

Referring to FIG. 6, the nail clipper 15' is desirably in most respects the same as the clipper 15 in FIG. 1 and includes a dual nail positioning device 47 comprising an antitilt plate 48 carried by the upper clipper arm 17' and an integral forwardly projecting nail length gauging shoulder 49 on the lower clipper arm 18'. The handle lever 23 and the pin 25 are the same as in FIG. 1 and therefore similarly identified, and function the same. Essentially, the positioning plate 48 is the same as the positioning plate 39, having an overhanging or overlying antitilt portion 50. An interlock offset portion 51 and an anchor portion 52 cooperate with the arm 17', the pin 25 and the handle lever 23 in the same manner as described for the plate 39. In this instance, the shoulder 49 which is engaged by the fingertip for gauging the length of the finger nail cut comprises a bulge in the jaw 21'.

Figure 7:
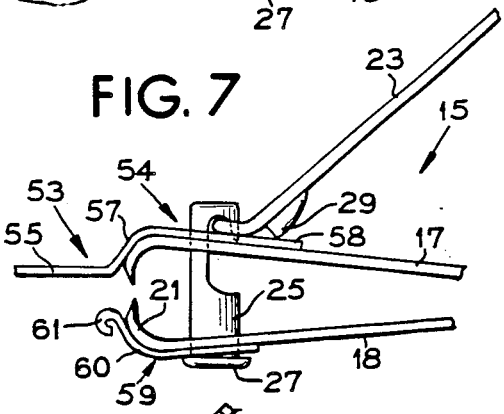
FIG. 7 is a similar side elevational view showing yet another modification.

In FIG. 7, the clipper 15 may be the same as the clipper 15 in FIG. 1 and is equipped with a dual nail positioning device 53 construction comprising an overlying plate member 54 having a forwardly projecting antitilt finger 55, an interlock offset 57 and a hold down or anchoring body portion 58 substantially the same as the generally corresponding plates 39 and 48 in FIGS. 4 and 6. As nail length gauging means the device 53 comprises a plate 59 which substantially snuggly conforms to the outer surface of the lower jaw 21 and the adjacent front under portion of the clipper arm 18 about the pin 25 extending through a suitable clearance perforation in the plate 59 which is held firmly against the surface of the arm 18 by the retaining flange 27 of the pin. An interlock offset 60 of the plate 59 conformably interlocks with the concave shape of the jaw 21 whereby to retain the plate 58 against swivelling out of position. A forwardly projecting curl 61 on the plate 59 provides a finger tip engageable stop shoulder for gauging the trim length of the finger nail, while the overlying plate portion 55 positions the nail against tilting.

Figure 8:
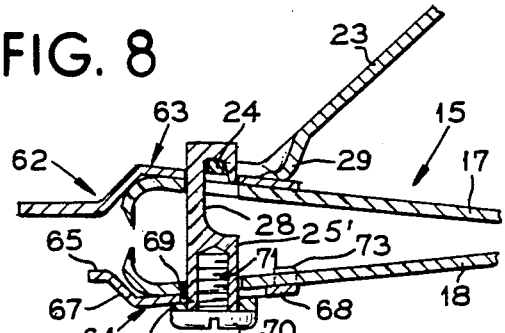
FIGS. 8, 9 and 10 are fragmentary longitudinal sectional detail views through a nail clipper like that in FIG. 1 but showing still other modifications.

In FIG. 8, the clipper 15 is substantially the same as the clipper in FIG. 1 and is equipped with a dual nail positioning device 62 comprising an antitilt plate 63 similar to the plates 39, 48 and 54 in respectively FIGS. 5, 6 and 7, but has a modified gauging shoulder plate 64 as compared to FIG. 7. The plate 64 has a forwardly projecting finger stop shoulder 65, an integral offset 67 and an anchor plate portion 68 which is engaged against the bottom of the forward area of the clipper arm 18 and has a clearance aperture 69 through which the lower portion of the pin 25' extends. Instead of an integral retaining flange in one piece at its lower end, the pin 25' has a retaining screw 70 which is threadedly engaged in a tapped bore 71 opening downwardly through the lower end of the pin 25'. The head flange of the screw 70 presses against a washer 72 to thrust the anchor portion 68 firmly against the bottom surface of the arm 18.

An advantageous feature of the plate 64 is that it can be adjusted longitudinally relative to the clipper arm 18 for selectively predetermined clipped nail lengths. For this purpose, the clearance aperture 69 is elongated longitudinally to permit longitudinal adjustment of the gauging plate member 64. To hold the plate member 64 against swivelling displacement, the anchor plate 68 may have on its rear portion respective upwardly extending guide lugs 73 (only one of which is shown) which slidably engage with the opposite edges of the arm 18.

Figure 9:
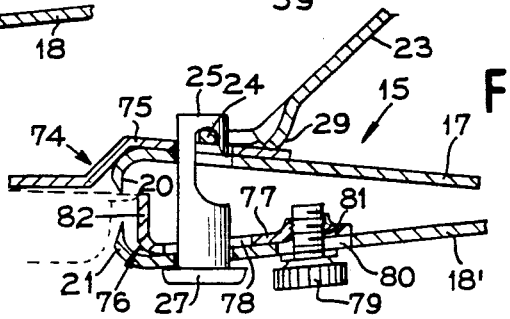

In FIG. 9 the clipper 15 is depicted as of substantially the same construction as the clipper 15 in FIG. 1 but with finger nail position device 74 of dual construction comprising an elevation positioning antitilt plate 75 of substantially the same construction as those shown in FIGS. 7 and 8 and cooperating with the arm 17, the jaw 20, the lever 23 and the pin 25 in the same manner. In addition, the device 74 has a finger nail length gauging member in the form of a plate 76 which is located on the inner face of the lower clipper arm 18' and inwardly from the lower jaw 21 with a base or anchor body portion 77 of the length gauge 76 having a longitudinally elongated clearance aperture 78 through which the pin 25 extends. For holding the member 76 in longitudinally adjusted position, a thumb screw 79 extends through a longitudinally elongated clearance aperture 80 in the arm 18' and is threaded into a tapped boss 81 on the rearward area of the base portion 77. At its front end, the member 76 has an upwardly projecting integral nail length gauging flange 82 against which the tip of a finger nail is engageable while the upper surface of the finger nail opposes the antitilt overhanging front finger of the member 75. Selective substantially accurate finger length trimming is adapted to be effected by the longitudinal adjustment of the member 76.

Figure 10:
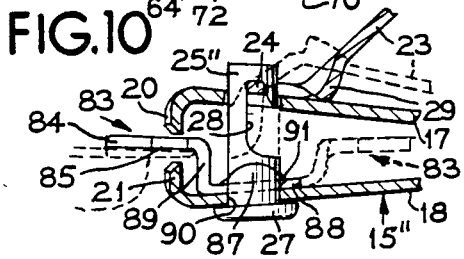

A dual nail positioning device 83 as shown in FIG. 10 comprises a one piece plate having a forwardly projecting overhead nail positioning flange portion 84 which is sufficiently wider than the width of the jaws 20 and 21 so that the upper jaw can extend through a clearance aperture 85 for clipping cooperation of the jaws when the clipper is activated by means of the handle lever 23 in its operating position shown in full outline on the clipper 15". In this instance, the connecting force transmission pin 25" has a flatted area 87 on at least one side for corotationally keying the device 83 by means of an anchoring base plate portion 88 which is connected at its front end by means of an offsetting angular portion 89 with the finger flange 84. It will be understood that the anchoring portion 88 has a clearance aperture 90 through which the flatted extent of the pin 25" extends in the corotative keyed relation. Depending upon the material from which the device 83 is made, the keyed engagement of the base portion 88 about the pin 25' may be warp fitted or distortion assembled with the pin, and if necessary secured against displacement axially relative to the pin as by holding means comprising adhesive cement, solder, or the like 91. If preferred, of course, the pin 25' may remain cylindrical and the positioning device base portion 88 as assembled about the pin simply retained in place by the holding means 91.

In use of the clipper 15", when the lever 23 is in the operative position, a nail to be trimmed is inserted in the space between the plate portion finger 84 and the cutting edge of the jaw 21 and the lever 23 depressed to drive the clipper arm 17 toward the clipper arm 18 and thrust the upper jaw 20 through the clearance aperture 85 into nail clipping cooperation with the lower jaw 21.

When it is desired to place the clipper 15" in nonoperating mode, the handle lever 23 is manuevered into the dot-dash orientation shown in FIG. 10, which involves, as is conventional, 180° rotation of the pin 25'. Since the device 83 is corotationally related to the pin 25", the turning of the pin into the nonoperating mode swings the device 83 into the nonoperating mode shown in dash outline extending rearwardly, out of the way between the clipper arms 17 and 18.

It will be apparent that the various forms of the nail positioning devices can be inexpensively produced from readily available materials either metal or suitable self-sustaining plastic having desirable characteristics for the present purposes.

It will be understood that variations and modifications may be effected without departing from the spirit and scope of the novel concepts of the present invention.

I claim as my invention:

1. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising a wireform structure having a nail supporting and finger stop bar located forwardly from said jaws and loop means encircling the pin;

and means for holding said device in nail positioning orientation relative to the clipper jaws when the lever is in the force applying operative relation.

2. A combination according to claim 1, wherein said device has supporting arms extending generally rearwardly from said bar in clearance relation to said jaws and connected to said loop means encircling said pin.

3. A combination according to claim 2, wherein said loop means includes holding means extension structure engaging said spring arms.

4. A combination according to claim 1, wherein said holding means comprises structure connecting said bar with said loop menas and cooperating with sides of said jaws.

5. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising a wireform structure having a nail supporting and finger stop bar located forwardly from said jaws an loop means encircling the pin;

means for holding said device in nail positioning orientation relative to the clipper jaws when the lever is in the force applying operative relation;

and said device comprising a plate member cooperating with said device and carried adjacent to one of said arms and having a nail positioning portion adjacent to said jaws.

6. A combination according to claim 5, wherein said positioning portion is located to overlie a finger nail being clipped by and between the jaws.

7. A combination according to claim 5, wherein said one arm is located above the other of said arms, and said plate member is carried on the top of said one arm.

8. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising a plate member mounted about said pin;

means for holding said plate member in nail positioning orientation relative to the clipper jaws when the lever is in the force applying operative relation; and said plate member being supported in relation to one of said arms, and the other of said arms having another nail positioning member cooperating with said plate member.

9. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising means for nail length gauging and means for antitilt positioning of a nail to be clipped;

means for holding both of said device means in nail positioning orientation relative to the clipper jaws when the lever is in the force applying operative relation;

one of said means comprising a wireform structure, and the other of said means comprising a plate structure.

10. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising means for nail length gauging and means for antitilt positioning of a nail to be clipped;

means for holding both of said device means in nail positioning orientation relative to the clipper jaws when the lever is in the force applying operative relation; and both of said device means comprising structures.

11. In combination with a nail clipper of the kind having a elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising means for nail length gauging and forwardly extending nail overhanging means for antitilt positioning of a nail to be clipped;

means for holding both of said device means in nail positioning orientation relative to the clipper jaws when the lever is in the force applying operative relation;

and said nail length gauging means being a plate mounted for longitudinal adjustment relative to one of said arms.

12. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising a plate member mounted about said pin;

means for holding said plate member in forwardly extending nail overhanging and antitilt positioning orientation relative to the clipper jaws when the lever is in the force applying operative relation;

and said plate member being longitudinally adjustable relative to said arms, and means for maintaining the plate member in selected longitudinally adjusted orientation.

13. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising a plate member mounted about said pin;

means for holding said plate member in forwardly extending nail overhanging and antitilt positioning orientation relative to the clipper jaws when the lever is in the force applying operative relation;

and said plate member being supported in relation to one of said arms, and the other of said arms having another nail positioning member cooperating with said plate member.

14. In combination with a nail clipper of the kind having elongated generally mirror image spring arms diverging from a fixed connection at one end and equipped at an opposite end with complementary normally spaced cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising means for nail length gauging and forwardly extending nail overhanging means for antitilt positioning of a nail to be clipped;

means for holding both of said device means in nail positioning orientation relative to the clipper jaws when the lever is in the force applying operative relation;

and one of said means comprising a wireform structure and the other of said means comprising a plate structure.

15. In combination with a nail clipper of the kind having elongated generally mirror image spring arms diverging from a fixed connection at one end and equipped at an opposite end with complementary normally space cutting edge jaws which face toward one another and are arranged to be driven into nail clipping engagement by an operating handle lever pivotally connected to a pin extending oscillatably through the arms adjacent to the jaws and permitting the lever to be swung selectively between a nail clipping force applying operative relation and an out of the way inactive relation to the arms, and including:

a nail positioning device comprising means for nail length gauging and forwardly extending nail overhanging means for antitilt positioning of a nail to be clipped;

means for holding both of said device means in nail positioning orientation relative to the clipper jaws when the lever is in the force applying operative relation;

and both of said device menas comprising plate structures.

* * * * *